US005918098A

United States Patent [19]

Van Bennekom

[11] Patent Number: 5,918,098

[45] Date of Patent: Jun. 29, 1999

[54] FUSER MEMBER WITH SILICONE RUBBER AND ALUMINUM OXIDE LAYER

[75] Inventor: Hans Lochmann Van Bennekom, Dansville, N.Y.

[73] Assignee: Xerox Corporation, Stamford, Conn.

[21] Appl. No.: 09/069,307

[22] Filed: Apr. 29, 1998

[51] Int. Cl.[6] ..... G03G 15/20

[52] U.S. Cl. ..... 399/333; 219/216; 428/421; 492/56

[58] Field of Search ..... 399/333, 330; 219/216, 469–471; 428/421, 906; 492/56, 59

[56] References Cited

U.S. PATENT DOCUMENTS

| | | | |
|---|---|---|---|
| 4,257,699 | 3/1981 | Lentz | 399/324 |
| 4,264,181 | 4/1981 | Lentz et al. | 399/324 |
| 4,711,818 | 12/1987 | Henry | 428/421 |
| 5,180,899 | 1/1993 | Inasaki | 219/469 |
| 5,248,339 | 9/1993 | Fitzgerald et al. | 118/60 |
| 5,269,740 | 12/1993 | Fitzgerald et al. | 492/56 |
| 5,291,257 | 3/1994 | Cerrah et al. | 399/233 |
| 5,292,562 | 3/1994 | Fitzgerald et al. | 428/35.8 |
| 5,292,606 | 3/1994 | Fitzgerald | 428/35.8 |
| 5,534,347 | 7/1996 | Chen et al. | 399/320 X |
| 5,582,917 | 12/1996 | Chen et al. | 428/421 |
| 5,587,245 | 12/1996 | Visser et al. | 428/447 |
| 5,595,823 | 1/1997 | Chen et al. | 428/421 |
| 5,729,813 | 3/1998 | Eddy et al. | 399/333 |
| 5,763,129 | 6/1998 | Chen et al. | 399/333 X |

*Primary Examiner*—S. Lee
*Attorney, Agent, or Firm*—Annette Bade

[57] ABSTRACT

A fuser member having a) a substrate; and thereover b) an intermediate filled elastomeric layer with silicone rubber and an aluminum oxide in an amount of from about 0.05 to about 5 percent based on the total volume of the intermediate layer; having thereover c) a outer polymeric layer; having thereover d) an optional outer surfactant layer; and thereover e) an optional fluid release layer.

30 Claims, 3 Drawing Sheets

FUSER MEMBER WITH SILICONE RUBBER AND ALUMINUM OXIDE LAYER

CROSS REFERENCE TO RELATED APPLICATIONS

Attention is directed to copending application Attorney Reference No. D/97633, U.S. application Ser. No. 09/069,476, filed Apr. 29, 1998, entitled, "METHOD OF COATING FUSER MEMBERS." The disclosure of this reference is hereby incorporated by reference in its entirety.

BACKGROUND OF THE INVENTION

The present invention relates to a fuser member and method for fusing toner images in an electrostatographic reproducing, including digital, apparatus. The fuser member is especially useful for fusing color images. More specifically, the present invention relates to apparatuses directed towards fusing toner images using a fuser member having a silicone rubber layer with metal oxide fillers such as aluminum oxide dispersed or contained therein, and in preferred embodiments, the silicone rubber and aluminum oxide layer is an intermediate layer of the fuser member. In a preferred embodiment, a relatively low amount of aluminum oxide is used in the silicone rubber layer. In a particularly preferred embodiment, the fuser member comprises a silicone rubber/aluminum oxide filler intermediate layer and an outer polymeric layer.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes it to be firmly bonded to the support.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members.

Known fuser members include those with outer layers of polytetrafluoroethylene to which a release agent such as silicone oil has been applied. More recently, silicone rubber and fluoroelastomers such as VITON® (Trademark from E. I. DuPont) coated fuser members have been used to enhance copy quality. The following are known fuser members.

U.S. Pat. No. 5,595,823 discloses a fuser member having a layer including a cured fluorocarbon random copolymer having subunits of vinylidene fluoride, hexafluoropropylene and tetrafluoroethylene and having aluminum oxide filler along with alkali metal oxides and/or alkali metal hydroxide fillers incorporated into the fuser member layer. A polydimethylsiloxane and mercapto fuser oil are also disclosed.

U.S. Pat. No. 4,711,818 discloses a fuser member having a core, and an outer layer comprising a crosslinked product of a mixture of at least one addition curable vinyl terminated or vinyl pendant polyfluoroorganosiloxane, heat stabilizer, filler, crosslinking agent and crosslinking catalyst. The filler may be calcined or tabular alumina.

U.S. Pat. No. 5,729,813 discloses a fuser member having a core and a surface layer comprising a fluoroelastomer and an alumina filler present in an amount of from about 30 to about 55 parts by weight, which corresponds to from about 11 to about 20 volume percent alumina. There may be present an intermediate silicone layer.

U.S. Pat. No. 5,292,606 discloses a fuser member having a base cushion layer comprising polydimethyl siloxane and at least one outer layer, wherein zinc oxide is present in the base cushion layer. The reference discloses that the zinc oxide particles can be replaced with aluminum oxide particles in a preferred amount of 8 to 40 volume percent.

U.S. Pat. No. 4,257,699 discloses a fuser member having a core and two outer layers. Example 1 discloses a base member, a silicone intermediate layer containing aluminum oxide particles, and an outer silicone rubber layer containing silver particles.

In color fusing, normally customer preference for color prints is a high gloss or matte opaque finish. This usually requires the use of smooth, conformable fuser roll operating at a high temperature and having a long-dwell nip. In addition, extra release agent is necessary for improving toner release due to the increase in toner used for color developing. For developing color images, several layers of different color toner are deposited on the latent image resulting in extra thickness (higher toner pile height) of unfused toner on a color image. Therefore, a higher operating temperature for color fusers is necessary to fuse the additional amount of toner. Further, extended dwell time at the nip is necessary to ensure complete toner flow. In addition, a conformable fuser member is necessary in order to ensure sufficient release and stripping. Moreover, a smooth surface is necessary in order to provide color images with preferred increased gloss.

However, known fuser members do not provide the same quality for colored images as they do for black and white images. Therefore, it is desired to provide a fuser member, preferably in combination with a pressure member, wherein high quality color prints or copies are produced. Particularly, it is desired to provide fuser members demonstrating excellent results at the higher temperatures necessary in color fusing. It is further desirable to provide fuser members possessing smooth, conformable layers having a long-dwell nip and a decrease in swell. In addition, it is desired to provide fuser members which require little or no fusing oil on the outer surface, while still providing excellent release. Further, it is desired to provide fuser members which provide complete toner flow, and increased gloss. Moreover, it is desired to reduce or eliminate pinhole defects in fuser members.

SUMMARY OF THE INVENTION

In embodiments, the present invention relates to: a fuser member comprising: a) a substrate; and thereover b) an intermediate elastomeric layer comprising silicone rubber and comprising aluminum oxide in an amount of from about 0.05 to about 5 percent based on the total volume of the intermediate layer; and thereover c) an outer polymeric layer.

Embodiments of the present invention further include: an image forming apparatus for forming images on a recording medium comprising: a charge-retentive surface to receive an electrostatic latent image thereon; a development component to apply toner to said charge-retentive surface to develop said electrostatic latent image to form a developed image on said charge retentive surface; a transfer component to transfer the developed image from said charge retentive surface to a copy substrate; and a fuser member for fusing toner images to a surface of said copy substrate, wherein said fuser member comprises: a) a substrate; and thereover b) an intermediate elastomeric layer comprising silicone rubber and comprising aluminum oxide in an amount of from about 0.1 to about 5 percent based on the total volume of the intermediate layer; and thereover c) an outer polymeric layer.

Embodiments also include: a fusing apparatus for fusing color toner, comprising a fuser member in pressure contact with a pressure member, wherein at least one of said fuser member and pressure member comprises a) a substrate; and thereover b) an intermediate elastomeric layer comprising silicone rubber and comprising aluminum oxide in an amount of from about 0.1 to about 5 percent based on the total volume of the intermediate layer; thereover c) an outer polymeric layer; and thereover d) an outer surfactant layer.

BRIEF DESCRIPTION OF THE DRAWINGS

For a better understanding of the present invention, reference may be had to the accompanying figures.

DETAILED DESCRIPTION OF THE PRESENT INVENTION

Figure 1:
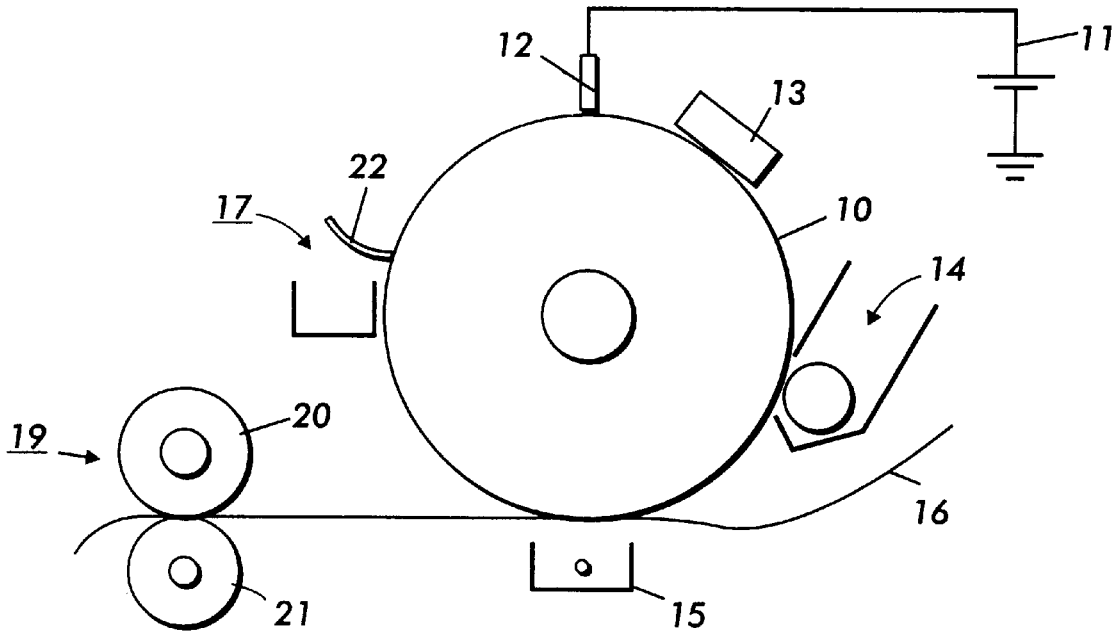
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
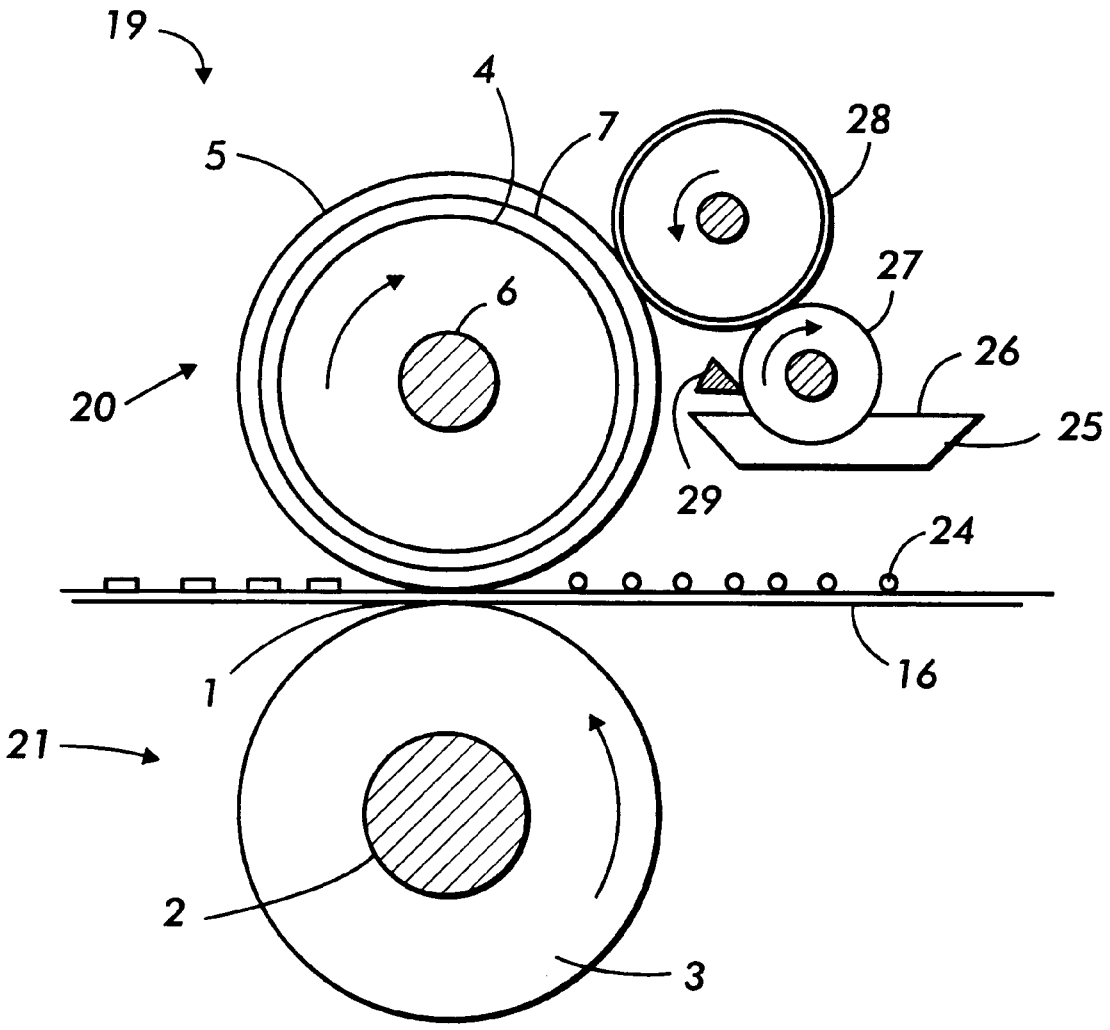
FIG. 2 illustrates a fusing system in accordance with an embodiment of the present invention.

Referring to FIG. 2, an embodiment of a fusing station 19 is depicted with an embodiment of a fuser roll 20 comprising polymer surface 5 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. The fuser member 20 can include an adhesive, cushion, or other suitable layer 7 positioned between core 4 and outer layer 5. Backup or pressure roll 21 cooperates with fuser roll 20 to form a nip or contact arc 1 through which a copy paper or other substrate 16 passes such that toner images 24 thereon contact elastomer surface 5 of fuser roll 20. As shown in FIG. 2, an embodiment of a backup roll or pressure roll 21 is depicted as having a rigid steel core 2 with a polymer or elastomer surface or layer 3 thereon. Sump 25 contains polymeric release agent 26 which may be a solid or liquid at room temperature, but it is a fluid at operating temperatures. The pressure member 21 may include a heating element (not shown).

In the embodiment shown in FIG. 2 for applying the polymeric release agent 26 to polymer or elastomer surface 5, two release agent delivery rolls 27 and 28 rotatably mounted in the direction indicated are provided to transport release agent 26 to polymer or elastomer surface 5. Delivery roll 27 is partly immersed in the sump 25 and transports on its surface release agent from the sump to the delivery roll 28. By using a metering blade 29, a layer of polymeric release fluid can be applied initially to delivery roll 27 and subsequently to polymer or elastomer 5 in controlled thickness ranging from submicrometer thickness to thicknesses of several micrometers of release fluid. Thus, by metering device 29, preferably from about 0.1 to about 2 micrometers or greater thicknesses of release fluid can be applied to the surface of polymer or elastomer 5.

Figure 3:
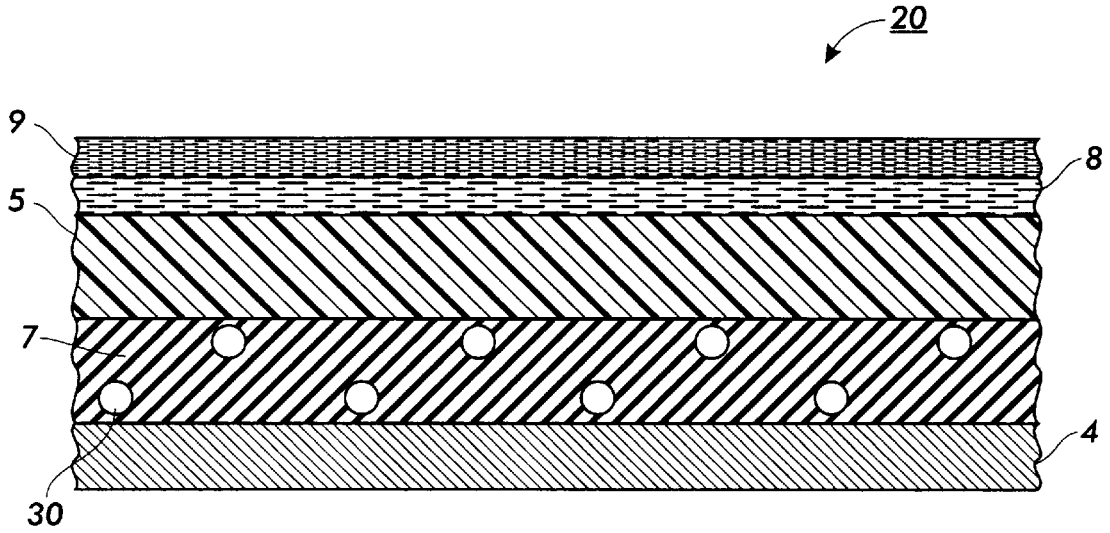
FIG. 3 demonstrates a cross-sectional view of an embodiment of the present invention.

FIG. 3 depicts a cross-sectional view of a preferred embodiment of the invention, wherein fuser member 20 comprises substrate 4, intermediate surface layer 7 comprising silicone rubber and aluminum oxide fillers 30 dispersed or contained therein, and outer polymeric surface layer 5. FIG. 3 also depicts optional surfactant layer 8 and optional fluid release agent layer 9.

Fuser member as used herein refers to fuser members including fusing rolls, belts, films, sheets and the like; donor members, including donor rolls, belts, films, sheets and the like; and pressure members, including pressure rolls, belts, films, sheets and the like; and other members useful in the fusing system of an electrostatographic or xerographic, including digital, machine. The fuser member of the present invention may be employed in a wide variety of machines and is not specifically limited in its application to the particular embodiment depicted herein.

Any suitable substrate may be selected for the fuser member. The fuser member substrate may be a roll, belt, flat surface, sheet, film, or other suitable shape used in the fixing of thermoplastic toner images to a suitable copy substrate. It may take the form of a fuser member, a pressure member or a release agent donor member, preferably in the form of a cylindrical roll. Typically, the fuser member is made of a hollow cylindrical metal core, such as copper, aluminum, stainless steel, or certain plastic materials chosen to maintain rigidity, structural integrity, as well as being capable of having a polymeric material coated thereon and adhered firmly thereto. It is preferred that the supporting substrate is a cylindrical metal roller. In one embodiment, the core, which may be an aluminum or steel cylinder, is degreased with a solvent and cleaned with an abrasive cleaner prior to being primed with a primer, such as Dow Corning 1200, which may be sprayed, brushed or dipped, followed by air drying under ambient conditions for thirty minutes and then baked at 150° C. for 30 minutes.

The intermediate layer preferably comprises a silicone rubber of a thickness so as to form a conformable layer. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; and 106 RTV Silicone Rubber and 90 RTV Silicone Rubber, both from General Electric. Other suitable silicone materials include the silanes, siloxanes (preferably polydimethylsiloxanes) such as, fluorosilicones, dimethylsilicones, liquid silicone rubbers such as vinyl crosslinked heat curable rubbers or silanol room temperature crosslinked materials, and the like.

Silicone rubber materials tend to swell during the fusing process, especially in the presence of release agent. In the case of fusing color toner, normally a relatively larger amount of release agent is necessary to enhance release due to the need for a larger amount of color toner than required for black and white copies and prints. Therefore, the silicone rubber is more susceptible to swell in an apparatus using color toner. Aluminum oxide added in a relatively small amount reduces the swell and increases the transmissibility of heat. This increase in heat transmissibility is preferred in fusing members useful in fusing color toners, due to the fact that a higher temperature (for example, from about 155 to about 180° C.) is needed to fuse color toner as compared to the temperature required for fusing black and white toner (for example, from about 50 to about 180° C.).

Therefore, dispersed or contained in the intermediate silicone rubber layer is aluminum oxide in a relatively low amount of from about 0.05 to about 5 percent, preferably from about 0.1 to about 5 percent, and particularly preferred from about 2.2 to about 2.5 percent by total volume of the intermediate layer. In addition to the aluminum oxide, other metal oxides and/or metal hydroxides may be used. Such metal oxides and/or metal hydroxides include tin oxide, zinc oxide, calcium hydroxide, magnesium oxide, lead oxide, chromium oxide, copper oxide, and the like, and mixtures thereof. In a preferred embodiment, a metal oxide is present in an amount of from about 10 to about 50 percent, preferably from about 20 to about 40 percent, and particularly preferred from about 30 to about 35 percent by total volume of the intermediate layer. In a preferred embodiment copper oxide is used in these amounts in addition to the aluminum oxide. In a particularly preferred embodiment, copper oxide is present in an amount of from about 30 to about 35 percent and aluminum oxide is present in an amount of from about 2.2 to about 2.5 percent by total volume of the intermediate layer. In preferred embodiments, the particle size of the metal oxides such as aluminum oxide or copper oxide is from about 1 to about 10 microns, preferably from about 3 to about 5 microns.

In general, the intermediate filled silicone layer has a thickness of from about 0.05 to about 10 mm, preferably from about 0.1 to about 5 mm, and preferably from about 1 to about 3 mm. More specifically, if the intermediate filled silicone layer is present on a pressure member, it has a thickness of from about 0.05 to about 5 mm, preferably from about 0.1 to about 3 mm, and particularly preferred from about 0.5 to about 1 mm. When present on a fuser member, the intermediate filled silicone layer has a thickness of from about 1 to about 10 mm, preferably from about 2 to about 5 mm, and particularly preferred from about 2.5 to about 3 mm. In a preferred embodiment, the thickness of the intermediate layer of the fuser member is higher than that of the pressure member so that, the fuser member is more deformable than the pressure member.

Examples of suitable outer fusing layers of the fuser member herein include polymers such as fluoropolymers. Particularly useful fluoropolymer coatings for the present invention include TEFLON®-like materials such as polytetrafluoroethylene (PTFE), fluorinated ethylenepropylene copolymer (FEP), perfluorovinylalkylether tetrafluoroethylene copolymer (PFA TEFLON®), polyethersulfone, copolymers and terpolymers thereof, and the like. Also preferred are fluoroelastomers such as those described in detail in U.S. Pat. Nos. 5,166,031; 5,281,506; 5,366,772; 5,370,931; 4,257,699; 5,017,432; and 5,061,965, the disclosures each of which are incorporated by reference herein in their entirety. These fluoroelastomers, particularly from the class of copolymers, terpolymers, and tetrapolymers of vinylidenefluoride, hexafluoropropylene and tetrafluoroethylene and a possible cure site monomer, are known commercially under various designations as VITON A®, VITON E®, VITON E60C®, VITON E430®, VITON 910®, VITON GH® VITON GF®, VITON E45® and VITON B50®. The VITON® designation is a Trademark of E. I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS® a poly(propylene-tetrafluoroethylene) and FLUOREL II® (LII900) a poly(propylene-tetrafluoroethylenevinylidenefluoride) both also available from 3M Company, as well as the TECNOFLONS® identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON GF®, available from E. I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

Particularly preferred polymers for the outer layer include TEFLON®-like materials such as polytetrafluoroethylene (PTFE), fluorinated ethylenepropylene copolymer (FEP), perfluorovinylalkylether tetrafluoroethylene copolymer (PFA TEFLON®), due to their increased strength and less susceptibility to stripper finger penetration. Further, these preferred polymers, in embodiments, provide the ability to control microporosity which further provides oil/film control.

It is preferred that the outer polymeric fusing layer be coated to a thickness of from about 2 to about 25 microns, preferably from about 5 to about 15 microns, and particularly preferred from about 7 to about 14 microns.

In embodiments wherein a functional fuser oil is used, conductive fillers may be dispersed in the outer fusing layer of the fuser member. Preferred fillers are capable of interacting with any functional groups of the release agent to form a thermally stable film which releases the thermoplastic resin toner and prevents the toner from contacting the filler surface material itself. This bonding enables a reduction in the amount of oil needed to promote release. Further, preferred fillers promote bonding with the oil, without causing problems of scumming or gelling. In addition, it is preferred that the fillers be substantially non-reactive with the outer polymer material so that no adverse reaction occurs between the polymer material and the filler which would hinder curing or otherwise negatively affect the strength properties of the outer surface material.

In a preferred embodiment, there is no conductive filler present in the outer layer of the fuser member. In addition, it is preferred to use either a non-functional release agent with a TEFLON®-like material with no added conductive fillers, or alternatively, to use no fuser oil and no conductive fillers in the outer polymeric layer.

Other adjuvants and fillers may be incorporated in the layers in accordance with the present invention provided that they do not affect the integrity of the polymer material. Such fillers normally encountered in the compounding of elastomers include coloring agents, reinforcing fillers, and processing aids. Oxides such as magnesium oxide and hydroxides such as calcium hydroxide are suitable for use in curing many fluoropolymers.

The polymer layers of the present invention can be coated on the fuser member substrate by any means including normal spraying, dipping and tumble spraying techniques. A flow coating apparatus as described in U.S. application Ser. No. 08/672,493 filed Jun. 26, 1996, entitled, "Flow Coating Process for Manufacture of Polymeric Printer Roll and Belt Components," the disclosure of which is hereby incorporated herein in its entirety, can also be used to flow coat a series of fuser rolls. It is preferred that the polymers be diluted with a solvent, and particularly an environmentally friendly solvent, prior to application to the fuser substrate. However, alternative methods can be used for coating layer including methods described in Attorney Reference No. D/97633, U.S. application Ser. No. 09/069,476, filed Apr. 29, 1998, entitled, "METHOD OF COATING FUSER MEMBERS," the disclosure of which is hereby incorporated by reference in its entirety.

In a preferred embodiment of the invention, the surface energy of the outer polymeric layer may be reduced by adding a surfactant to the outer surface. Further, addition of a surfactant, in embodiments, reduces pin hole defects by actually filling in or smoothing out any defects. In addition, in embodiments, the surfactant provides a uniform oil/film which aids in uniform gloss and helps prevent offsetting due to microporosity.

Examples of surfactants include anionic, cationic, zwitterionic and amphoteric surfactants. Preferred are cationic surfactants such as amine compounds such as alkyl amines, and ammonium compounds such as ammonium halides. Specific examples of useful surfactants include alkyl sulfates (such as STEPANOL® SLS surfactant, a product of Stepan Company); cationics including alkyl triammonium halides (such as CTAB® surfactant, a product of VWR Scientific Inc.), polyoxyethylene cocoamine (such as MAZEEN® surfactant, a product of PPG Industries), primary alkyl amines (such as ARMEEN® surfactant, a product of Akzo Chemical Co., and others such as ADOGEN® 180-C10 ether amine, ADOGEN® 183-C13 ether amine, ARO-SURF® MG-70A3 isodecyl ether amine acetate, and ARO-SURF® MG-70A5), dicoco dimethyl ammonium halide (such as JET QUAT® surfactant, a product of Jetco Chemical Inc.), di-isodecyl dimethyl ammonium halides (such as AMMONYX® K9 surfactant, a product of Stepan Company), diaminoethyl stearate (such as CERASYNT® 303); amphoteric surfactants such as sodium cocoamphotacetate from McIntyre Group, ADOGEN® 425-50% (a 50% aqueous solution of a trimethyl soya quaternary ammonium chloride surfactant), DERIPHAT® 154-L, a disodium N-tallow beta-iminodipropionate available from Henkel; any of the amine amphoterics from Akzo Chemicals, and anionic surfactants such as potassium sulphates, benzene sulphonates, ether sulphonates, sodium coconut oil fatty monoglyceride sulphates and sulphonates, the reaction products of fatty acids, and olefin sulphonates. Other suitable surfactants include fish oil such as KELLOX®-3-Z from Kellog Company, oleylamine from ARMEEN® O, or N-alkyl-1,3-diaminopropane dioleate, available as DUOMEEN® TDO, products of Akzo Chemie America.

A suitable surfactant can be coated on the outer polymeric layer by known methods, added to a fusing oil in solution form and then coated as a single coating, or embedded in the outer layer by known methods. The surfactant is either added to the oil in an amount of from about 1 to about 20 mils/liter, preferably from about 5 to about 10 mils/liter total volume coating (total volume coating meaning the total volume amount of oil and surfactant), or used as a coating in the following amount of from about 1 to about 20 mils/liter, and preferably from about 5 to about 10 mils/liter total volume coating (total volume coating of surfactant).

Polymeric fluid release agents can be used in combination with the polymer outer layer to form a layer of fluid release agent which results in an interfacial barrier at the surface of the fuser member while leaving a non-reacted low surface energy release fluid as an outer release film. Suitable release agents include both functional and non-functional fluid release agents. Preferred are the non-functional release agents including known polydimethyl siloxane release agents. However, functional release agents such as amino-functional, mercapto functional, hydride functional and others, can be used. Specific examples of suitable amino functional release agents include T-Type amino functional silicone release agents disclosed in U.S. Pat. No. 5,516,361; monoamino functional silicone release agents described in U.S. Pat. No. 5,531,813; and the amino functional siloxane release agents disclosed in U.S. Pat. No. 5,512,409, the disclosures each of which are incorporated herein in their entirety. Examples of mercapto functional release agents include those disclosed in U.S. Pat. Nos. 4,029,827; 4,029,827; and 5,395,725. Examples of hydride functional oils include U.S. Pat. No. 5,401,570. Other functional release agents include those described in U.S. Pat. Nos. 4,101,686; 4,146,659; and 4,185,140. Other release agents include those described in U.S. Pat. Nos. 4,515,884; and 5,493,376. However, it is preferred to use a non-functional release agent with the present fuser configuration.

However, in a preferred embodiment, little or no fuser release agent is necessary due to the increased release and decreased surface energy provided by the fuser members disclosed herein.

The fuser members are useful in combination with many toners, including black and white toner or color toner. However, the fuser members herein are particularly useful with color toners. Examples of suitable known color toners include those listed in U.S. Pat. Nos. 5,620,820; 5,719,002; and 5,723,245.

Other layers such as adhesive layers or other suitable layers may be incorporated between the outer polymer layer and the intermediate silicone rubber layer, or between the substrate and the intermediate silicone rubber layer.

The fuser members disclosed herein are particularly useful in color duplication and printing, including digital, machines. The fuser members demonstrate excellent results at the higher temperatures, for example from about 150 to about 180° C., necessary in color fusing. The fuser members possess smooth, conformable layers having a relatively long-dwell nip and a decrease in swell. In addition, the normally required additional release agent is not necessary for improving toner release due to the increase in toner used for color developing with embodiments of the present fuser members. The fuser members herein provide complete toner flow, and increased gloss due to the configuration of the fuser members. Further, pinhole defects are decreased or eliminated and the surface energy is decreased by use of a surfactant.

All the patents and applications referred to herein are hereby specifically, and totally incorporated herein by reference in their entirety in the instant specification.

The following Examples further define and describe embodiments of the present invention. Unless otherwise indicated, all parts and percentages are by weight of total solids as defined in the specification. Percentage by total volume refers to the amount per total volume of all the components in the particular layer.

EXAMPLES

Example I

Silicone and Metal Oxide Intermediate Layer with PTFE Outer Layer

A solution of silicone elastomer was prepared by mixing a silicone resin with a solvent. Aluminum oxide in an amount of about 2.2 percent by total volume of the silicone resin and copper oxide in an amount of about 35 percent by total volume was added after washing and drying the particles. The solution of silicone and fillers was sprayed onto the surface of an aluminum cylinder coated with an adhesive. The thickness of the layer was determined to be about 3 mm. The elastomer material was dried and heated to remove the solvent.

An outer layer of polytetrafluoroethylene (PTFE) was coated onto the silicone rubber using known molding or sleeving methods and was heated at a temperature of from about 327 to about 430° C. Alternatively, the silicone rubber layer and PTFE was simultaneously coated by molding or sleeving techniques, followed by sintering.

In a preferred embodiment, the fuser member coated with the above silicone/metal oxide layer, was oriented perpendicularly with respect to an expanded PTFE sheet and a first end of the fuser member was placed against the sheet. Keeping the fuser member end against the sheet, the rest of the sheet was wrapped from the first end to the second end of the fuser member so as to be continuously wrapped around the fuser member. The wrapped fuser member was then subjected to sintering which took place in a heating tube where heat and pressure were applied. The heating was accomplished at a temperature ranging from about 320 to about 435° C. and at a pressure ranging from about 5 to about 30 PSI, preferably from about 340 to about 360° C. and at from about 10 to about 15 PSI.

A surfactant ARMEEN® (a primary alkyl amine surfactant available from Akzo Company) was coated onto the outer polymeric surface by coating the outer polytetrafluoroethylene layer with an ARMEEN® soaked rag.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

We claim:

1. A fuser member comprising: a) a substrate; and thereover b) an intermediate elastomeric layer comprising silicone rubber and comprising aluminum oxide in an amount of from about 0.05 to about 5 percent based on total volume of the intermediate elastomeric layer; and thereover c) an outer polymeric layer.

2. A fuser member in accordance with claim 1, wherein said aluminum oxide is present in an amount of from about 0.1 to about 5 percent by total volume of the intermediate layer.

3. A fuser member in accordance with claim 1, wherein said aluminum oxide is present in an amount of from about 2.2 to about 2.5 percent by total volume of the intermediate layer.

4. A fuser member in accordance with claim 1, wherein said intermediate layer further comprises copper oxide in an amount of from about 10 to about 50 percent by total volume of the intermediate layer.

5. A fuser member in accordance with claim 4, wherein said intermediate layer further comprises copper oxide in an amount of from about 20 to about 40 percent by total volume of the intermediate layer.

6. A fuser member in accordance with claim 5, wherein said intermediate layer further comprises copper oxide in an amount of from about 30 to about 35 percent by total volume of the intermediate layer.

7. A fuser member in accordance with claim 1, wherein said intermediate layer has a thickness of from about 0.05 to about 10 mm.

8. A fuser member in accordance with claim 7, wherein said intermediate layer has a thickness of from about 0.1 to about 5 mm.

9. A fuser member in accordance with claim 1, wherein said outer polymeric layer comprises a fluoropolymer.

10. A fuser member in accordance with claim 9, wherein said fluoropolymer is selected from the group consisting of polytetrafluoroethylene, fluorinated ethylenepropylene copolymer, and perfluorovinylalkylether tetrafluoroethylene copolymer.

11. A fuser member in accordance with claim 9, wherein said fluoropolymer is a fluoroelastomer selected from the group consisting of a) copolymers of vinylidenefluoride, hexafluoropropylene and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene and a cure site monomer.

12. A fuser member in accordance with claim 11, wherein said fluoroelastomer comprises about 35 weight percent of vinylidenefluoride, about 34 weight percent of hexafluoropropylene, about 29 weight percent tetrafluoroethylene, and about 2 weight percent cure site monomer.

13. A fuser member in accordance with claim 1, wherein said outer polymeric layer has a thickness of from about 2 to about 25 microns.

14. A fuser member in accordance with claim 13, wherein said outer polymeric layer has a thickness of from about 5 to about 15 microns.

15. A fuser member in accordance with claim 1, further comprising an outer surfactant layer on said outer polymeric layer.

16. A fuser member in accordance with claim 15, wherein said surfactant is selected from the group consisting of anionic, cationic, zwitterionic, and amphoteric surfactants.

17. A fuser member in accordance with claim 16, wherein said surfactant is a cationic surfactant.

18. A fuser member in accordance with claim 17, wherein said surfactant is a primary alkyl amine.

19. A fuser member in accordance with claim 15, further comprising a fluid release layer over said outer surfactant layer.

20. A fuser member in accordance with claim 19, wherein said fluid release layer comprises a non-functional release agent.

21. A fuser member in accordance with claim 1, wherein said fuser member is a cylindrical pressure roller.

22. A fuser member in accordance with claim 21, wherein said intermediate layer has a thickness of from about 0.05 to about 5 mm.

23. A fuser member in accordance with claim 22, wherein said intermediate layer has a thickness of from about 0.1 to about 3 mm.

24. A fuser member in accordance with claim 1, wherein said fuser member is a cylindrical fuser roller.

25. A fuser member in accordance with claim 24, wherein said intermediate layer has a thickness of from about 1 to about 10 mm.

26. A fuser member in accordance with claim 25, wherein said intermediate layer has a thickness of from about 2 to about 5 mm.

27. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fuser member for fusing toner images to a surface of said copy substrate, wherein said fuser member comprises: a) a substrate; and thereover b) an intermediate elastomeric layer comprising silicone rubber and comprising aluminum oxide in an amount of from about 0.05 to about 5 percent based on total volume of the intermediate elastomeric layer; and thereover c) an outer polymeric layer.

28. An image forming apparatus in accordance with claim 27, wherein said toner is a color toner.

29. A fuser apparatus for fusing color toner, comprising a fuser member in pressure contact with a pressure member, wherein at least one of said fuser member and pressure member comprises a) a substrate; and thereover b) an intermediate elastomeric layer comprising silicone rubber and comprising aluminum oxide in an amount of from about 0.05 to about 5 percent based on total volume of the intermediate elastomeric layer; thereover c) an outer polymeric layer; and thereover d) an outer surfactant layer.

30. A fuser apparatus in accordance with claim 29, wherein both of said fuser member and pressure member comprise a) a substrate; and thereover b) an intermediate elastomeric layer comprising silicone rubber and comprising aluminum oxide in an amount of from about 0.05 to about 5 percent based on the total volume of the intermediate layer; thereover c) an outer polymeric layer; and thereover d) an outer surfactant layer.

* * * * *